US005375527A

United States Patent [19]

Nakajima

[11] Patent Number: 5,375,527

[45] Date of Patent: Dec. 27, 1994

[54] METHOD FOR BLASTING EMPLOYING BAR-LIKE CHARGE

[76] Inventor: Yasuji Nakajima, 7-13, Morinosato 4-chome, Atsugi 243-01, Japan

[21] Appl. No.: 931,589

[22] Filed: Aug. 18, 1992

[30] Foreign Application Priority Data

Feb. 25, 1992 [JP] Japan ..... 4-086716

[51] Int. Cl.[5] ..... F42D 3/00

[52] U.S. Cl. ..... 102/301; 102/312

[58] Field of Search ..... 102/301, 312

[56] References Cited

U.S. PATENT DOCUMENTS

| | | | |
|---|---|---|---|
| 4,205,610 | 6/1980 | Zerga | 102/23 |
| 4,262,965 | 4/1981 | Ricketts | 299/2 |
| 4,976,199 | 12/1990 | Beukes et al. | 102/200 |
| 5,014,622 | 5/1991 | Jullian | 102/312 |
| 5,090,325 | 2/1992 | Saito et al. | 102/313 |

OTHER PUBLICATIONS

Japan Industrial Explosive Association "New Industrial Explosive" published on Oct. 1, 1985, pp. 198 to 200.

"Explosive Safety Text Series 17, Application of Explosive in Occasions" edited by Ministry of International Trade and Industry, Ground Emission Division, published by Shadan Hojin Zenkoku Kayakurui Hoan Kyokai, Jan., 1991, pp. 45 to 46.

*Primary Examiner*—Peter A. Nelson

*Attorney, Agent, or Firm*—Trexler, Bushnell, Giangiorgi & Blackstone, Ltd.

[57] ABSTRACT

The present invention is to provide a method for blasting employing bar-like charge, having a pure blasting coefficient for maximum fracturing performance without causing danger of flying rock or so forth. At first, digging a random length H of a blast hole consisting of a charge length N and a least resistance distance W from the upper end of the charge length N to a free surface G. Secondly, defining a first and second distances D1 and D2, as limitation of fracture force acting on the free surface G, of each length corresponding to the least resistance distance W and corresponding to each other from an opening end E of the blast hole. Finally, defining a charge amount L under the condition of which a blasting coefficient c, namely, a proportion of the charge amount L to a fracture rock volume $V=H\times D1\times D2$ is within from 0.25 to 0.45.

1 Claim, 3 Drawing Sheets

METHOD FOR BLASTING EMPLOYING BAR-LIKE CHARGE

BACKGROUND OF THE INVENTION

1. Field of the Invention

The present invention relates to a method for blasting in bar-like charge, more particularly, relates to a method for blasting employing bar-like charge being capable of ensuring a blasting under safety condition without causing danger of flying rock.

2. Description of the Related Art

A number of accidents by blasts for construction works in Japan from 1979 to 1989 are counted 261, in which accidents by flying rock resulting from blasts are counted 160 cases, which are 61.3%.

In the prior art, in a single point concentrated charge system for blasting as shown in FIG. 1, a charge amount (L) of an explosive is expressed by Hauser's equation:

$$L=cW^3 \quad (1)$$

wherein

L: charge amount (kg)

c: blasting coefficient

W: line of least resistance (m)

From the foregoing Hauser's equation of blasting, the blasting coefficient c can be expressed by:

$$c=L/W^3 \quad (2)$$

The foregoing Hauser's equation of blasting is established under the following conditions:

1. Full charge amount L is charged in the single point concentrated charge system;

2. The blasting is a single freedom surface blasting. and

3. The proper charge amount, namely the charge amount for obtaining maximum fracture effect within a safety range, in which flying rock or scattering stone will not be caused, is determined with respect to funnel shape blasting configuration of W=r, in which the fracture radius r on a free surface G is equal to the line of least resistance W.

Accordingly, the volume V of the funnel hole is expressed by:

$$V=\tfrac{1}{3}\times\pi r^2\times W$$

Here, from the condition of W=r as set forth above, and since $\pi\approx 3$, the foregoing equation (3) can be modified as:

$$V=W^3 \quad (3)$$

By replacing $W^3$ in the foregoing equation (2) with V in the equation (3), the equation (2) can be expressed by:

$$c=L/V \quad (4)$$

As can be appreciated herefrom, the blasting coefficient c is a ratio of the single point concentrated charge amount L versus the fracture volume of the rock with the charged explosive. The blasting coefficient c as set forth above can be established when the three dimensions $Wr^2$ forming the fracture volume V are equal to each other. (see Japan Industrial Explosive Association, "NEW INDUSTRIAL EXPLOSIVE", Oct. 1, 1985, pages 198 to 200)

On the other hand, in simultaneous blasting with bar-like charging system as shown in FIG. 2, the charge amount L is expressed by:

$$L=c\times H\times D1\times D2 \quad (5)$$

By modifying the foregoing equation (5), the blasting coefficient c is expressed by:

$$c=L/(H\times D1\times D2)=L/V \quad (6)$$

Here, the relationship between the distances D1 and D2 between blast holes and the blast hole length H has to be:

$$(D1=D2)<H$$

wherein

D1: distance between the blast holes E and A;

D2: distance between the blast holes E and B;

L: charge amount of explosive; and v: fracture rock volume "H×D1×D2" corresponding to the charge amount L.

(see, "Explosive Safety Text Series 17, Application of Explosive in Occasions" edited by Ministry of International Trade and Industry, Ground Emission Division, published by Shadan Hojin Zenkoku Kayakurui Hoan Kyokai, January, 1991, pages 45 to 46)

This inventor's viewpoint is as follows; namely, the blasting coefficient c represents the fracture force acting on free surface G. In other words, the blasting coefficient c represents the degree of upward force along the least resistance line W toward the free surface from the upper end of the charge length N.

Accordingly, when the charge amount L is to be determined, in excessive consideration is given for safety so as not to cause flying rock or scattering stone, the fracture force becomes excessively small to degrade efficiency of the blasting operation. Conversely, when excessively high efficiency is attempted by increasing the charge amount, it may cause flying rock to cause danger. Therefore, in order to optimize blasting operation, it is essential to properly determine the blasting efficient c in view of the balance of the safety and efficiency of the blasting operation, so that the maximum rock fracture can be obtained within a safety range, in which the flying rock may not be caused.

In reviewing of the blasting coefficient c derived through the conventional method in viewpoint set forth above, it should be true that, in the single point concentrated charge system, for which the Hauser's equation of blasting is applicable, since all of the fracture force necessary for fracturing the rock volume $V=r^2W$ is a fracture force acting on the free surface, the volume V per se is the pure value forming the denominator of the value c of the blasting coefficient. (see foregoing equation (4))

However, in case of the blasting with bar-like charge system, it is not true that the fracture force necessary for fracturing total rock volume V=H×D1×D2 is the fracture force acting on the free surface. (see the foregoing equation (6))

Namely, the total fracture rock volume V=H×D1 and D2 is a sum of the rock volume fractured by the upward force toward the free surface G and the rock volume fractured by the force which contributes only force fracturing lower rock without contributing upward fracturing toward the free surface G. Therefore, the pure blasting coefficient c has to be determined with the denominator corresponding to the rock volume fractured only by the upward fracturing force toward the free surface. In this regard, the rock volume to be fractured by the downward fracturing force which does not contribute for upward fracturing, has to neglected.

Therefore, in the foregoing equation (5), the value c called as the blasting coefficient in the blasting operation with bar-line charge system, cannot be a pure value, but, in practice, a fracturing rock unit indicative of the ratio of the total fracturing rock volume V. Assuming this value as k for the illustration, the foregoing equation (5) can be expressed by:

$$L=k\times H\times D1\times D2 \quad (5a)$$

and similarly, the foregoing equation (6) can be expressed by:

$$k=L/(H\times D1\times D2) \quad (6a)$$

As set forth above, the blasting coefficient c derived through the conventional method, contains an error in determination of the volume forming the denominator value. Namely, since the calculation is performed with including the element which should not be associated with derivation of the blasting coefficient c, reference values are set at 0.10~0.30 (see page 46 of foregoing "Explosive Safety Text Series 17, Application of Explosive in Occasions") which are much smaller than typical proper blasting coefficients 0.25~0.45.

However, if those skilled in the art who is not knowledgeable about the uncertain element in derivation of the blasting coefficient c in the bar-like charge system in the conventional manner, applies the typical proper value of the blasting coefficients 0.25~to 0.45 as element for deriving the charge amount of the explosive, it can be feared on causing flying rock to make blasting operation dangerous.

SUMMARY OF THE INVENTION

Therefore, it is an object of the present invention to provide a method for blasting employing bar-like charge, having a pure blasting coefficient by clarifying a volume forming the denominator of the blasting coefficient, for maximum fracturing performance without causing danger of flying rock or so forth.

In order to accomplish above-mentioned object, a method for a blasting employing bar-like charge system comprises the step of as follows; at first, as shown in FIG. 3, digging a random length H of a blast hole consisting of a charge length N and a least resistance distance W from the upper end of said charge length N to a free surface G, secondly, as shown in FIG. 4, defining a first and second distances D1 and D2, as limitation of fracture force acting on the free surface G, of each length corresponding to said least resistance distance W and corresponding to each other from an opening end E of the blast hole, and finally, as shown in FIGS. 5 or 6, defining a charge amount L under the condition of which a blasting coefficient c, namely, a proportion of said charge amount L to a fracture rock volume $V=H\times D1\times D2$ is within from 0.25 to 0.45.

Since the blasting coefficient c is a control coefficient associated with the upward fracturing force reaching the free surface G, the value forming the base is a distance W between the upper end of the charge length N of the explosive charged or loaded in the blast hole length H and the free surface G, namely the least resistance line W, instead of the blast hole length H as in the prior art. (see FIG. 3)

Next, if three dimensions W, D1 and D2 for deriving the fracturing rock volume V1 are set in random manner without any restrictive factor for deriving the blasting coefficient c, the following problems are expected to be caused. Namely, even when the resultant volumes V1 become the equal value, such value can be established with the three dimensions W, D1 and D2 including a substantially large value and a substantially small value. In review, it can be found that the factor to cause the flying rock may be seen in the part of the smaller value.

Therefore, in viewpoint of prevention of the flying rock, namely in viewpoint of the blasting coefficient c, the three dimensions W, D1 and D2 should have least difference therebetween. Namely, it is required for the three dimensions to establish $W=D1=D2$ or $W\approx D1\approx D2$. In such case, the fracturing rock volume V1 becomes true cone or cubic configuration. This fracturing rock volume V1 is the factor which can be the denominator for the pure blasting coefficient. (see FIGS. 5 and 6)

If the foregoing conditions are satisfied, $k=L/V$ taking the total fracturing rock volume $V=H\times D1\times D2$ to be fractured by the bar-shaped charge amount L can be regarded as the pure blasting coefficient c. This is because that the total fracturing rock volume V naturally incorporates the fracturing rock volume V1 associated with derivation of the blasting coefficient c, and that the ratio of the fracturing rock volume unit $k=L/V$ is unchanged for the fracturing rock volume V1.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment, but are for explanation and understanding only.

In the drawings.

DESCRIPTION OF THE PREFERRED EMBODIMENT

Figure 1:
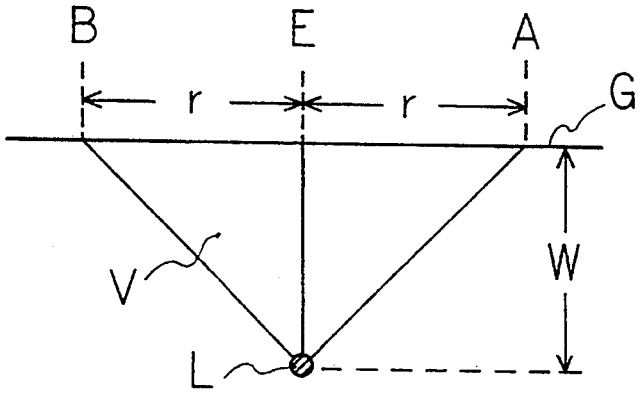
FIG.1 PRIOR ART
FIG. 1 is an explanatory illustration showing the conventional manner of deriving a blasting coefficient in a single point concentrated charging.
Figure 2:
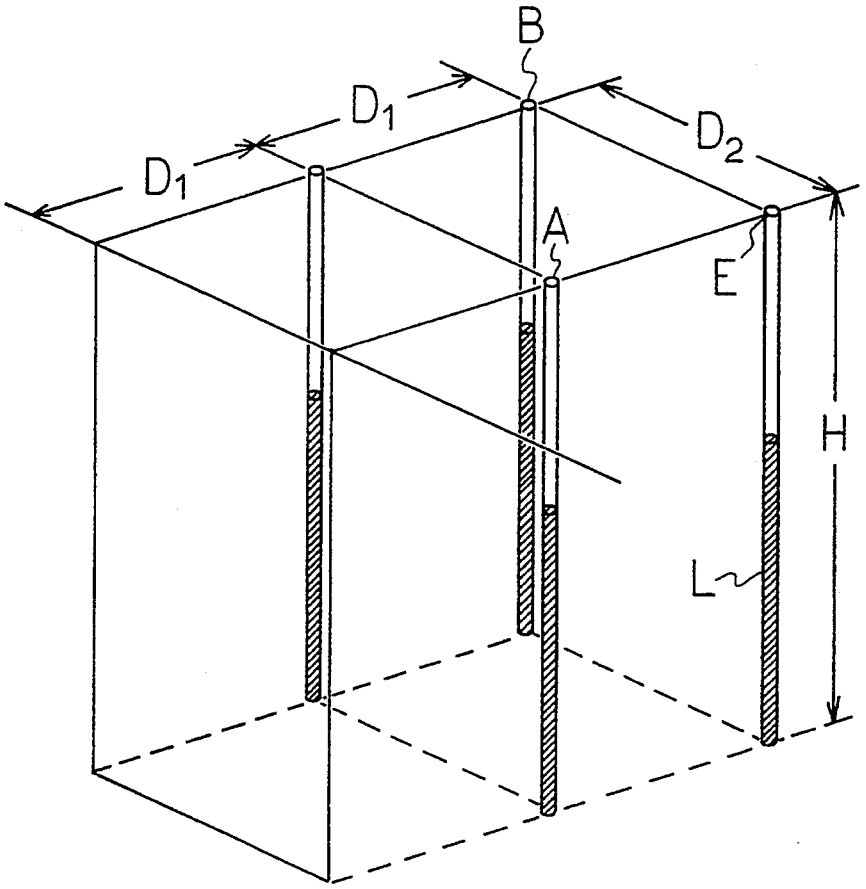
FIG.2 PRIOR ART
FIG. 2 is an explanatory illustration showing the conventional manner of deriving a blasting coefficient in a simultaneous blasting with bar-shaped charging.
Figure 3:
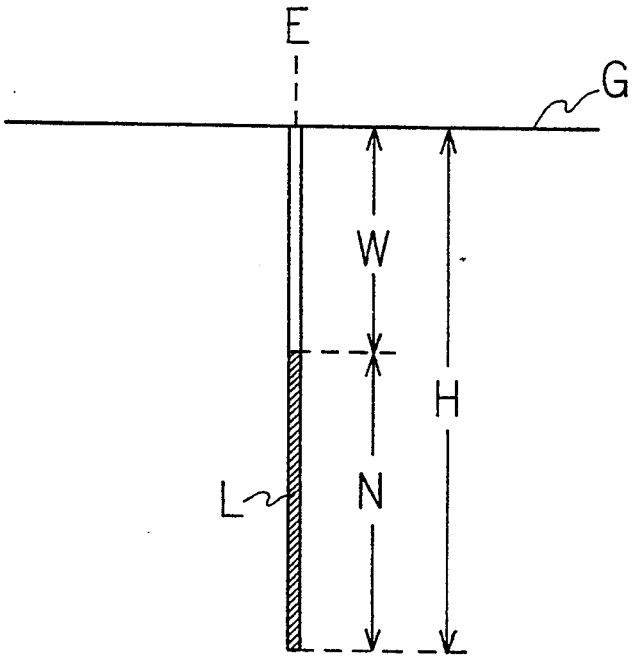
FIG. 3 is an explanatory illustration showing a least resistance distance W to be based for determining a pure blasting coefficient in blasting with bar-like charging of explosive, according to the present invention.
Figure 4:
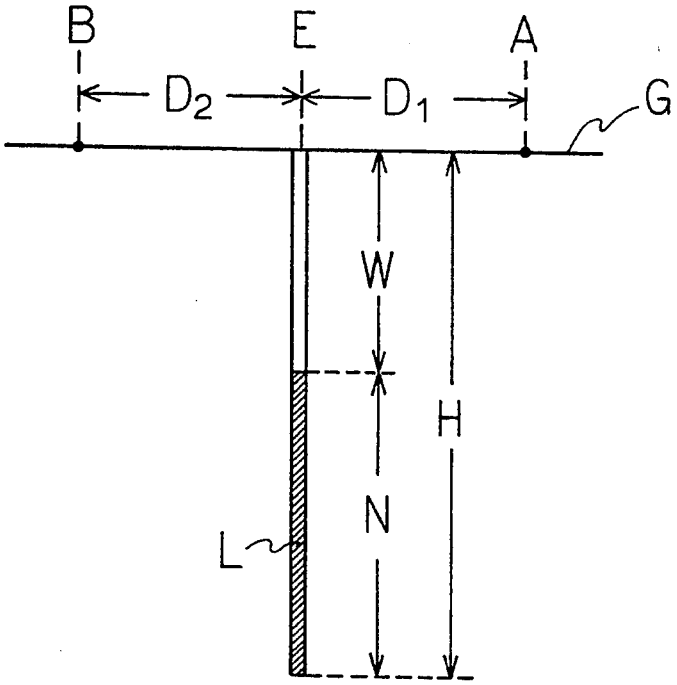
FIG. 4 is an explanatory illustration showing a first and second distances D1 and D2 to be based for determining the pure blasting coefficient according to the invention.
Figure 5:
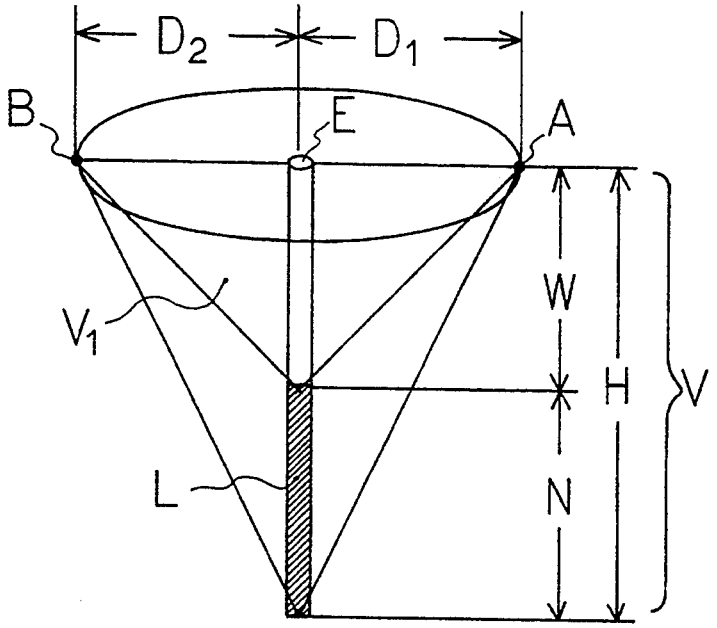
FIG. 5 is an explanatory illustration showing a method for blasting in bar-like charge having the pure blasting coefficient according to the invention.
Figure 6:
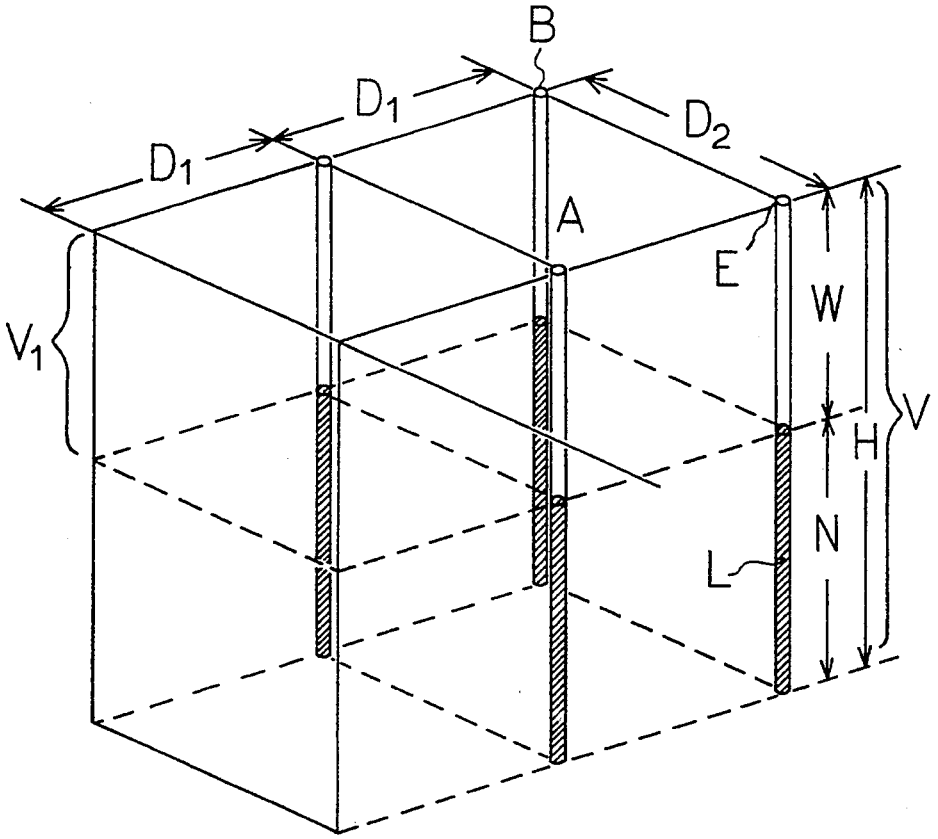
FIG. 6 is an explanatory illustration showing modification of a method for blasting in bar-like charge having the pure blasting coefficient according to the invention.

Further detailed discussion for the present invention will be given for the specific embodiments for the illustrative purpose.

In case that a blast hole diameter is 25 mm, a blast hole length B is 3 m, a charge amount per 1 m is 0.41 kg/m, a charge length N is 2 m, a least resistance length W is 1 m, and charge amount L is 0.82 kg (0.41×2), a value k is expressed by $$k=L/(H\times D1\times D2)$$

from the foregoing equation (6a).

Here, assuming W=D1=D2, $$k=0.82/(3\times1\times1)=0.27$$

$$k=c$$

Therefore, the blasting coefficient c is derived to be 0.27 which is a safety value without causing danger of flying rock. Accordingly, said charge amount L =0.82 kg is proper value.

In the foregoing parameters, when the least resistance length W is set at 0.8 m, the charge length N becomes 2.2 m, and the charge amount L becomes 0.90 kg (0.41 ×2.2). In this case, the value k is expressed by $$k=L/(H\times D1\times D2)$$

from the foregoing equation (6a).

Here, assuming W=D1=D2, $$k=0.90/(3\times0.8\times0.8)=0.47$$

$$k=c$$

Therefore, the blasting coefficient c is derived to be 0.47 which is a dangerous value. Accordingly, said charge amount L=0.90 kg must be reduced.

On the other hand, in case that a blast hole diameter is 33 mm, a blast hole length H is 15 m, a charge amount per 1 m is 0.58 kg/m, a charge length N is 13.5 m, a least resistance length W is 1.5 m, and charge amount L is 7.83 kg (0.58×13.5), a value k is expressed by $$k=L/(H\times D1\times D2)$$

from the foregoing equation (6a).

Here, assuming W=D1=D2, $$k=7.83/(15\times1.5\times1.5)=0.23$$

$$k=c$$

Therefore, the blasting coefficient c is derived to be 0.23 which is a safety value.

In the foregoing parameters, when the least resistance length W is set at 1.1 m, the charge length N becomes 13.9 m, and the charge amount L becomes 8.06 kg (0.58×13.9). In this case, the value k is expressed by:

$$k=L/(H\times D1\times D2)$$

from the foregoing equation (6a).

Here, assuming W=D1=D2, $$k=8.06/(15\times1.1\times1.1)=0.44$$

$$k=c$$

Therefore, the blasting coefficient c is derived to be 0.44 which is close to a dangerous value in the safety range. Accordingly, said charge amount L=8.06 kg is close to a dangerous value.

As can be appreciated herefrom, according to the present invention, a fracturing rock volume V1 forming the denominator in derivation of the blasting coefficient c is clearly distinguished from the total fracturing rock volume V, and the three parameters W, D1 and D2 for deriving the fracturing volume V1 are set approximately equal values as essential condition for deriving the pulse blasting coefficient c. Furthermore, according to the present invention, a fracturing rock unit value k which satisfies the foregoing condition is regarded as the blasting coefficient c. This make definite the derivation blasting coefficient c which is otherwise held indefinite and thus can be a cause of flying rock accident by erroneous application.

Furthermore, according to the present invention, since the pure blasting coefficient can be derived, method for blasting in bar-like charge has the optimal blasting coefficient with avoiding error, so as to obtain maximum fracturing force within a safety range not causing the flying rock, certainly, easily and quickly.

What is claimed is:

1. A method for blasting employing bar-like charge comprising the steps:

digging a random length H of a blast hole consisting of a charge length N and a least resistance distance W from the upper end of said charge length N to a free surface G, defining a first and second distances D1 and D2, as limitation of fracture force acting on the free surface G, of each length corresponding to said least resistance distance W and corresponding to each other from an opening end E of the blast hole, and charging an amount L under the condition of which a blasting coefficient c, namely, a proportion of said charge amount L to a fracture rock volume V=H×D1×D2 is within from 0.25 to 0.45.

* * * * *

UNITED STATES PATENT AND TRADEMARK OFFICE

CERTIFICATE OF CORRECTION

PATENT NO. : 5,375,527

DATED : December 27, 1995

INVENTOR(S) : Yasuji Nakajima

It is certified that error appears in the above-indentified patent and that said Letters Patent is hereby corrected as shown below:

Column 5, Line 8 "hole length B" should read — hole length H —

Signed and Sealed this

Fourth Day of April, 1995

Bruce Lehman

*Attest:*

BRUCE LEHMAN

*Attesting Officer*

*Commissioner of Patents and Trademarks*